US005326976A

United States Patent [19]

Kikuchi

[11] Patent Number: 5,326,976

[45] Date of Patent: Jul. 5, 1994

[54] RADIATION MEASURING DEVICE FOR MEASURING DOSES FROM A RADIOTHERAPY APARATUS

[75] Inventor: Hiroshi Kikuchi, Amagasaki, Japan

[73] Assignee: Mitsubishi Denki Kabushiki Kaisha, Tokyo, Japan

[21] Appl. No.: 894,637

[22] Filed: Jun. 5, 1992

[30] Foreign Application Priority Data

Jun. 5, 1991 [JP] Japan ..... 3-133906

[51] Int. Cl.[5] ..... H01J 47/02

[52] U.S. Cl. ..... 250/385.1

[58] Field of Search ..... 250/385.1

[56] References Cited

U.S. PATENT DOCUMENTS 3,852,610 12/1974 McIntyre ..... 250/385.1

5,079,427 1/1992 Vlasbloem ..... 250/374

FOREIGN PATENT DOCUMENTS 60-172155 9/1985 Japan ..... 250/385.1

*Primary Examiner*—Constantine Hannaher

*Attorney, Agent, or Firm*—Rothwell, Figg, Ernst & Kurz

[57] ABSTRACT

A radiation monitor has an ionization space formed with a frame made of insulating material, a high-voltage electrode, and a collecting electrode opposing the high-voltage electrode. The ionization space has an equal dimension throughout the passage of a radiation. Therefore, the Boyle-Charles' law applies almost perfectly to the ionization space. Thus, an ionization current can be extracted without the influence of an ambient pressure or temperature.

5 Claims, 5 Drawing Sheets

RADIATION MEASURING DEVICE FOR MEASURING DOSES FROM A RADIOTHERAPY APARATUS

BACKGROUND OF THE INVENTION

1. Field of the Invention

The present invention relates to a radiation monitor, or more particularly, to a radiation monitor capable of monitoring a dose originating from a radiotherapy apparatus, a non-destructive inspection radiologic equipment, or other radiation generating apparatus without the influence of an ambient temperature of air pressure.

2. Description of the Related Art

FIG. 6 is a schematic diagram showing a radiation generating apparatus by the name of a medical linac or linear accelerator. In FIG. 6, a gantry 52 is installed to rotate against a stand 51 with a virtual rotation axis 53 as a center. A virtual point 54 referred to as an isocenter and thought to be a center of a therapeutic radiation is an intersection between the rotation axis 53 and a radiation center axis 21 to be described later.

Equipment for generating radiations are incorporated in the gantry 52. The equipment will be described in detail. That is to say, the gantry 52 accommodates an electron gun 55 for generating electrons, an accelerating tube 56 for accelerating electrons to produce a high energy, a vacuum beam duct 57 running through the accelerating tube 56 for routing accelerated electrons, and a deflecting electromagnet 58 for deflecting electrons. 59 is an orbit of the electrons. Also incorporated is a metallic target against which electrons collide to generate an X ray. For electron beam therapy, a scatterer for scattering electrons is installed at the position of the target 60 on behalf of the target 60.

Distribution of an X ray the target 60 generates is restricted by a primary collimator 61. A flattening filter 62 is installed to flatten the energy spectrum within the distribution of the X ray the target 60 generates. If a scatterer is used as the target 60 for electron beam therapy, a numeral 62 denotes a secondary scatterer. The intensity of an X ray or an electron beam is monitored by a radiation monitor 63.

Collimator blocks 64 and 65 control distribution of an X ray according to the size of a lesion to be treated. As shown in FIG. 6, the collimator block 64 is made up of a pair of blocks 64*a* and 64*b*. The collimator block 65 lies almost perpendicularly to the collimator block 64 and consists of a pair of blocks, which are not shown, similarly to the collimator block 64.

A virtual center axis is running perpendicularly to the target 60, which is referred to as a beam center 21. A radiation 20 represents the distribution of a radiation restricted by the primary collimator 61. A patient treatment table 66 is provided with a tabletop 67 on which a patient 68 lies.

FIG. 7 is a cross-sectional diagram showing a transmission type parallel plate chamber representing an example of a radiation monitor 63. A high-voltage electrode 2 serves as one of parallel plates, which is formed with a thin metallic or metal-deposited insulating sheet. A collecting electrode 3 collects ionized ions or electrons, which is made of the same material as the high-voltage electrode 2. A frame 4 is hollowed in the form of a column or prism, supporting and isolating the two electrodes 2 and 3. The electrodes 2 and 3, and frame 4 form a sealed ionization space 1 in which gas is ionized with a radiation.

The electrodes 2 and 3 are locked in the frame 4 with a bracket 5 and a set screws 7. A general earth electrode 28 serving as a thin metal cover is installed to protect the electrodes 2 and 3. A seal 6 is employed to shield a space formed with the metallic cover 28 and frame 4 from gas coming from an external space of a radiation monitor. A high-voltage connector 8 is installed to supply high voltage via an external circuit. Also installed is a collecting electrode connector 9 for providing the ions or electrons the collecting electrode 3 collects as ionization current.

FIG. 8 shows a transmission type parallel plate chamber representing other example of a conventional radiation monitor 63*a*. In the radiation monitor 63*a* of FIG. 8, unlike a radiation monitor 63 of FIG. 7, a frame 4 is formed as a rigid plate including electrodes 2 and 3. The volume of an ionization space 1 does not vary depending on an external temperature or an air pressure. The ionization space 1 is shielded from external gas.

FIG. 9 is a schematic diagram for explaining the relationship between a radiation monitor 63 or 63*a* and an external circuit. In FIG. 9, an electrode 2 is connected to a high-voltage power supply 71 via a high-voltage connector 8. An electrode 3 is connected to a current-voltage converter 72 for converting ionization current into voltage, an amplifier 73, a display 74 for indicating a dose, and a control system 75 for feeding back the operation of a medical linac according to a monitored dose via a collecting electrode connector 9.

Next, the operations will be described. In radiotherapy using the configuration of FIG. 6, a patient 68 is positioned by operating a treatment table 66 and a tabletop 67, so that the lesion will align with an isocenter 54.

As for a therapeutic radiation, electrons an electron gun 55 emits are accelerated by an accelerating tube 56 to yield a given level of energy. Then, the electrons are deflected by a deflecting electromagnet 58 to follow an orbit 59. Finally, the electrons hit a target 60.

As a result, an X ray develops from the target 60. The X ray is controlled by a primary collimator 61 to form a radiation 20. The radiation 20 represents an energy spectrum symmetrical with respect to a beam center axis 21. To meet therapeutic needs, the energy spectrum of the radiation 20 must be uniform, which, therefore, is flattened by a flattening filter 62.

In treatment planning for electron beam therapy, a scatterer for scattering an electron beam is installed at the position of the target 60 and a secondary scatterer is placed at the position of the flattening filter 62. Thus, an electron beam distribution becomes uniform over the regions of the radiation 20. Then, the radiation 20 irradiates a lesion of the patient 68. At this time, depending on the size of the lesion, a pair of collimator blocks 64 and 65 is used to align the electron beam with a given region.

For electron beam therapy, an applicator (not shown) may be employed to confine a passage of an electron beam from the collimator block 65 to a patient.

The aforesaid radiation generating mechanism is locked in a gantry 52. Then, the gantry 52 is rotated against a stand 51 around a rotation axis 53 so that the radiation 20 can be irradiated from around the body axis of a patient 68.

Radiotherapy is proceeded as described previously. A dose of a radiation 20 incident on a patient 68 must be monitored in real time. It is a radiation monitor 63 or 63a to detect the dose of the radiation 20.

FIG. 7 shows an example of a conventional radiation monitor 63. In FIG. 7, a high-voltage electrode 2 is opposing a collecting electrode 3 to form a so-called transmission type parallel plate chamber. The electrodes 2 and 3 run through a frame 4 to reach respective electrode connectors 8 and 9. A metallic cover 28 is fixed to the frame with a bracket 5 and a screw 7. Thus, the metallic cover 28 and a seal 6 form an airtight ionization space 1.

A radiation ionizes gas when passing through the air. High voltage which is high enough to move ionized ions or electrons toward an electrode is supplied to the high-voltage electrode 2. Then, the collecting electrode 3 is grounded through a low impedance. An electric field develops between the electrodes 2 and 3. Ions or electrons ionized by the radiation are attracted to counter electrodes. The collecting electrode 3 collects either the ions or electrons, so that ionization current can be monitored as a dose.

FIG. 9 shows the foregoing procedure. A high-voltage power supply 71 supplies high voltage to a high-voltage electrode 2 via a high-voltage connector 8. A collecting electrode 3 is grounded through a low input impedance of a current-voltage converter 72. Ionization current is converted into voltage by the current-voltage converter 72, then amplified by an amplifier 73 to have a given strength. Then, the amplified signal indicates a dose on a display 74 and serves as an input of a control system 75. At this time, the relationship between the ionization current and dose is represented as follows:

$$i = kD \times PV/T \quad (1)$$

where, i is ionization current, k, a proportional constant, D, a radiation intensity, P, an air pressure in an ionization space, T, an absolute temperature in the ionization space, and V, a volume of an ionized region.

The expression (1) means that ionization current faithfully represents a radiation intensity but is affected by an air pressure or temperature. Therefore, an airtight space is formed as shown in FIG. 7 in an effort to minimize the influence of an air pressure or temperature.

A radiation monitor 63a shown in FIG. 8 is devised to avoid the influence of an air pressure or temperature. A frame 4 is made of ceramic or other tough and light material, having an airtight space inside. A high-voltage electrode 2 and a collecting electrode 3 are arranged in the space to form a transmission type parallel plate chamber.

In the foregoing configuration, the volume of the internal airtight space does not vary regardless of an external air pressure or temperature of the frame 4. As far as the volume of a sealed space does not vary, the quotient of P/T in the expression (1) is constant. Therefore, the dose monitor provides a value of ionization current which is proportional to a dose regardless of an external air pressure or temperature.

In the aforesaid conventional radiation monitor of FIG. 7, a space formed with a metallic cover 28 and a frame 4 is airtight. However, since a value V in the expression (1) does vary in an ionization space 1, the quotient of P/T does not become constant. This means that the monitored value is affected by an external air pressure or temperature. In FIG. 8, when an X ray whose energy is low enough to be absorbed into ceramic or other light material is irradiated, the radiation monitor works effectively. However, in electron beam therapy, dose absorption of the radiation monitor itself is too large to be ignored. This cripples electron beam therapy.

SUMMARY OF THE INVENTION

The object of the present invention is to solve the aforesaid problems or to provide a radiation monitor capable of extracting ionization current unaffected with an ambient pressure or temperature.

In order to achieve the above object, according to one aspect of the present invention, there is provided a radiation monitor for a radiation generating apparatus which generates radiations comprising: a frame made of an insulating material; a high-voltage electrode; and a collecting electrode opposing the high-voltage electrode; wherein an ionization space for developing ionization current with generation of a radiation being formed with the frame, the high-voltage electrode and the collecting electrode and the ionization space having an equal dimension throughout the passage of a radiation.

DESCRIPTION OF THE PREFERRED EMBODIMENTS

Figure 1A:
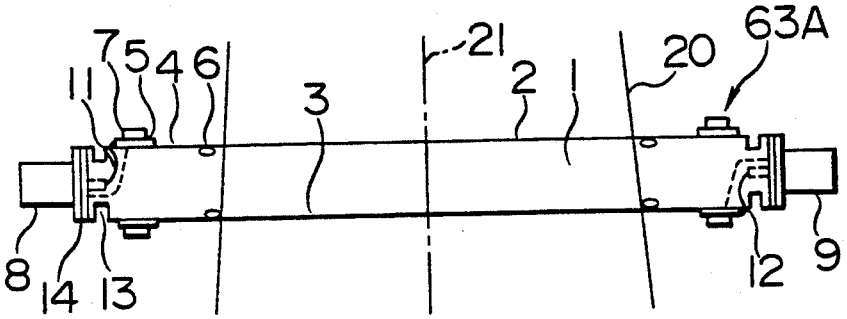
FIGS. 1A and 1B are a schematic cross-sectional diagram and a schematic plan view of a radiation monitor according to the first embodiment of the present invention.
Figure 1B:
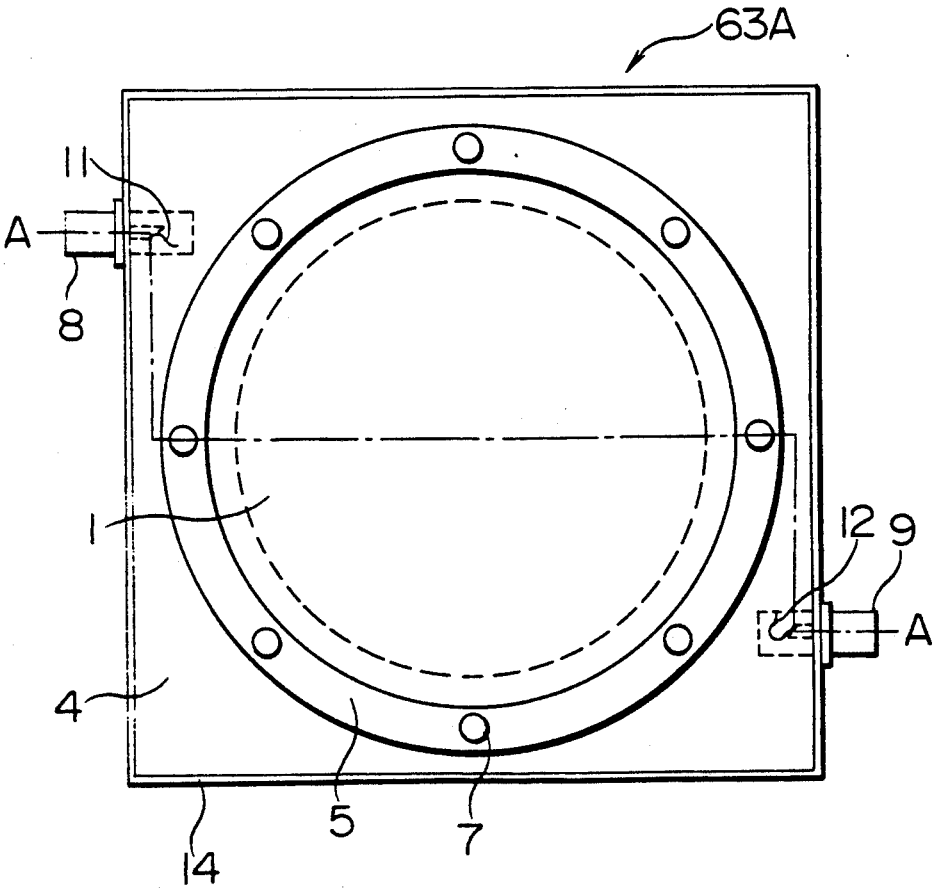

FIGS. 1A and 1B are a schematic cross-sectional diagram and a schematic plan view of a radiation monitor according to an embodiment of the present invention. In FIGS. 1A and 1B, members assigned the same symbols are the same or equivalent components. In FIGS. 1A and 1B, a radiation monitor 63A includes a high-voltage lead 11 and a collecting electrode lead 12. A ditch 13 for extending a creeping distance between a high-voltage electrode 2 and an earth and a protective earth electrode 14 for cutting off leakage current between the high-voltage electrode 2 and collecting electrode 3 are installed on the circumference of a frame 4.

Figure 3:
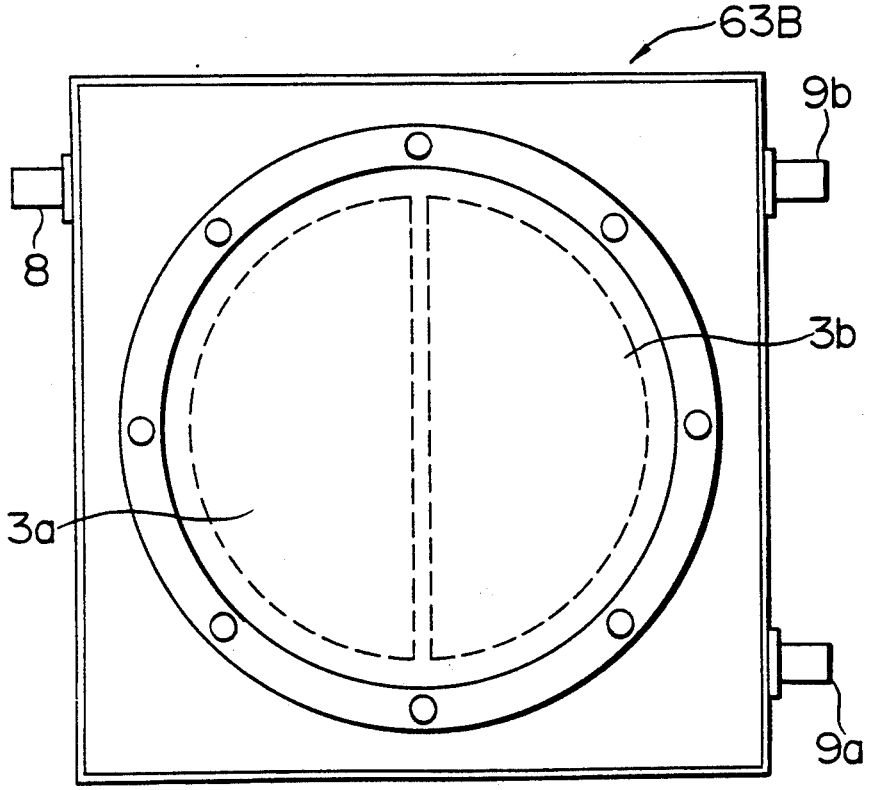
FIG. 3 is a schematic cross-sectional diagram showing a radiation monitor according to other embodiment of the invention.

A radiation monitor 63B in FIG. 3 has the same configuration as that in FIGS. 1A and 1B. However, metal is deposited on an insulating sheet symmetrically with respect to a beam center axis, forming collecting electrodes 3*a* and 3*b*. Connectors 9*a* and 9*b* are installed to extract ionization current the collecting electrodes 3*a* and 3*b* collect.

Figure 4:
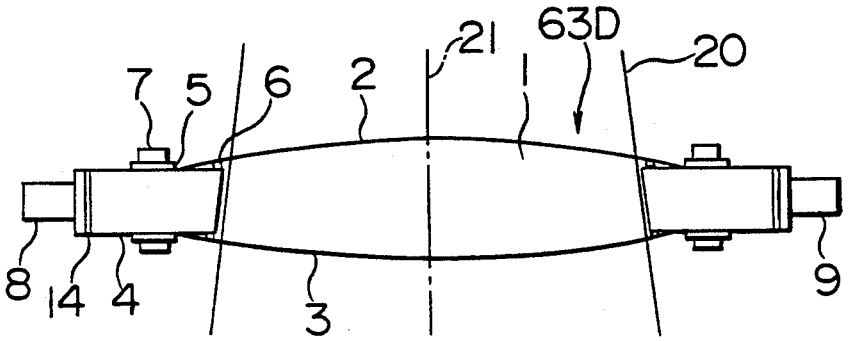
FIG. 4 is a schematic cross-sectional diagram showing a radiation monitor according to other embodiment of the invention.
Figure 5:
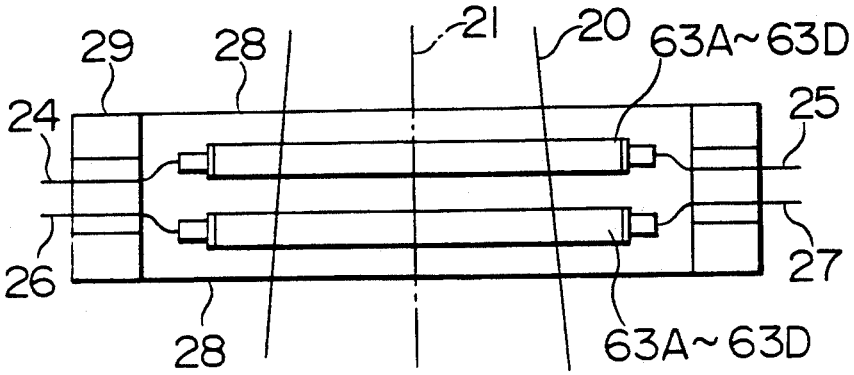
FIG. 5 is a schematic cross-sectional diagram showing a radiation monitor according to other embodiment of the invention.

In FIG. 5, any two of radiation monitors 63A to 63D are arranged along a beam center axis. Any combination of the radiation monitors 63A to 63D shown in FIGS. 1A and 1B to FIG. 4 is conceivable according to a therapeutic purpose. Numerals 24 to 27 denote cables for high-voltage and collecting electrodes. A metallic cover 28 is used to protect any of radiation monitors 63A to 63D from external variations. The metallic cover 28 is secured with a fixing frame 29.

Figure 6:
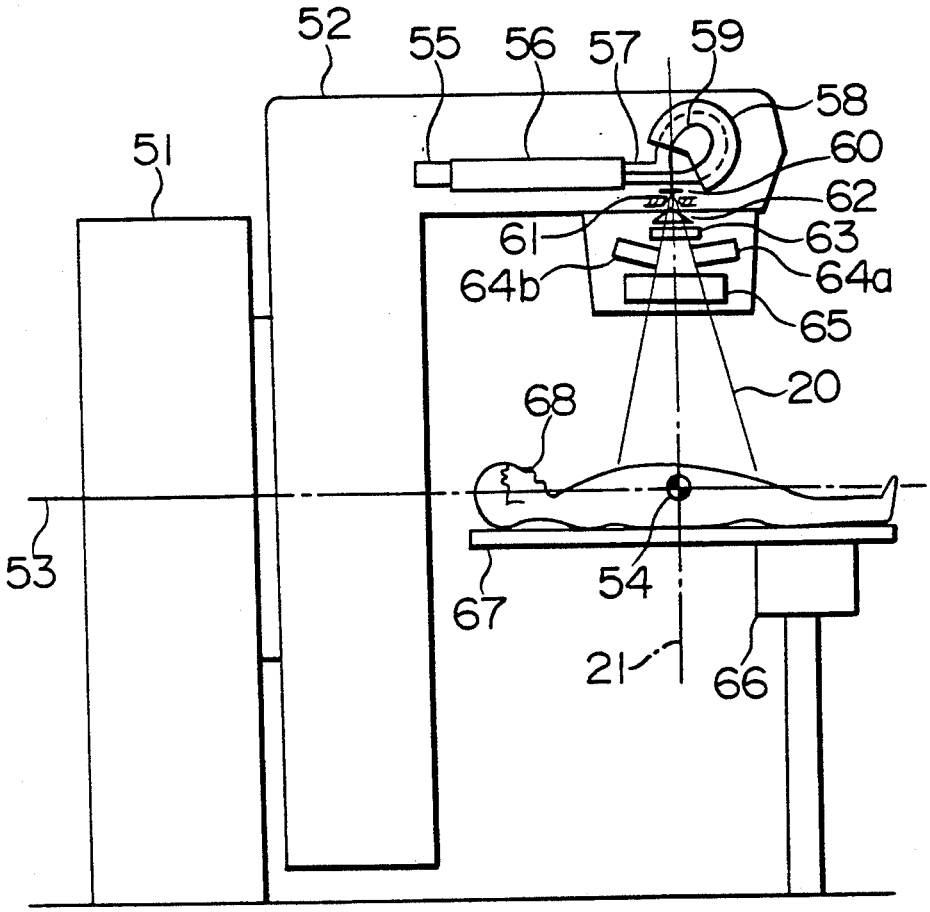
FIG. 6 is a schematic diagram showing a radiation generating apparatus.

Next, the functions and operations of the embodiments will be described. FIG. 1B is a plan view of a radiation monitor 63A viewed from a radiation source. A high-voltage electrode 2 and a collecting electrode 3 are locked in a frame 4 with a bracket 5. A seal 6 provides an internal ionization space 1 with an airtight structure. The ionization space 1 is indicated as an area inward of a dashed line in FIG. 1B. In FIG. 1A, the internal ionization space 1 of the frame 4 is shown as part of the conical beam of radiation 20 restricted by a primary collimator 61 shown in FIG. 6.

Figure 7:
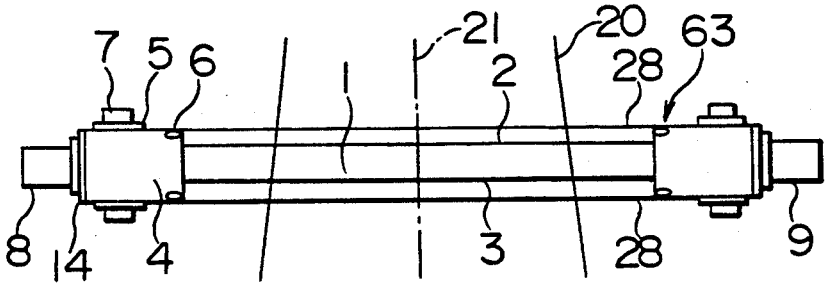
FIG. 7 PRIOR ART
FIG. 7 is a schematic cross-sectional diagram showing a conventional radiation monitor.

In the ionization space 1 formed with the high-voltage electrode 2, collecting electrode 3, and frame 4, gaseous molecules are all ionized with generation of a radiation 20. FIG. 7 shows three airtight regions or spaces; that is, an airtight space 1, a space coinciding with the passage of a radiation 20, interposing between the metallic cover 28 and the high-voltage electrode 2 or collecting electrode 3, and ionized to make no contribution to ionization current, and a space being outside a radiation 20 and airtight to develop no ionization current.

The internal airtight space bears a relationship represented as an expression (2) of the expression (1) (Boyle-Charles' law). That is to say, the quotient of PV/T in the aforesaid expression (1) is constant.

$$PV/T=\text{constant} \quad (2).$$

In FIG. 7, V represents the volume of an airtight space. Assuming that Vi is the volume of an ionization space, and Ve, that of other space, the expression (2) becomes as follows:

$$PV/T=P(Vi+Ve)/T=\text{constant} \quad (3).$$

On the other hand, the volume of an ionization space within an airtight space in FIG. 7 is constant regardless of an air pressure or temperature in the airtight space. That is to say, the following state is retained in the airtight space:

$$\text{Vi}=\text{constant} \quad (4)$$

wherein, gaseous molecules and ionized gas are mutually balanced and not subject to a deflection pressure. Therefore, to validate the expression (3), Ve must vary according to P and T. The resultant Vi is assigned to the expression (2).

$$PVi/T\neq\text{constant} \quad (5).$$

When the expression (5) is assigned to the expression (3), ionization current becomes dependent on an air pressure or temperature.

In FIG. 1A, ionization space 1 coincides with an airtight space. Assuming that the volume of the ionization space is Vs, the expression (2) is expressed as follows:

$$PVs/T=\text{constant} \quad (6).$$

When the expression (6) is assigned to the expression (1), an ionization current i is provided as a value unaffected by an air pressure or temperature, but proportional to a dose D.

Figure 8:
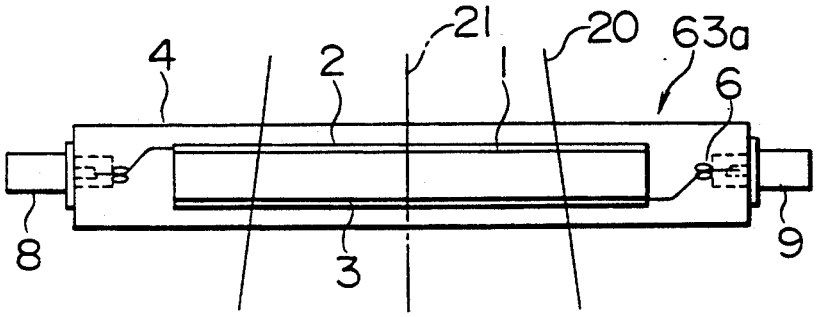
FIG. 8 PRIOR ART
FIG. 8 is a schematic cross-sectional diagram showing other conventional radiation monitor.
Figure 9:
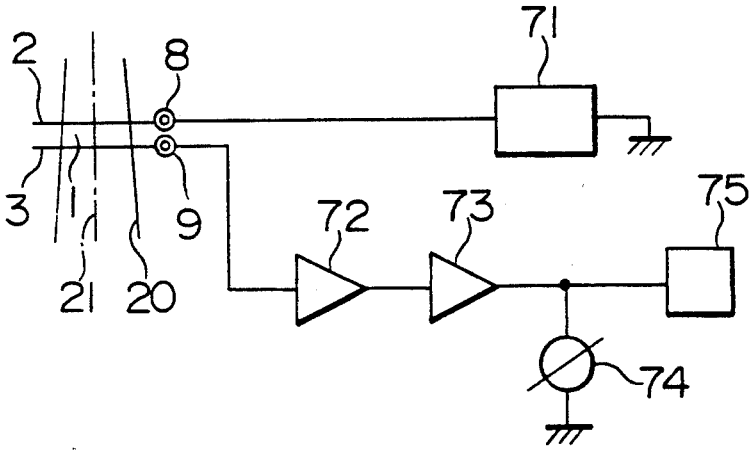
FIG. 9 is a schematic diagram for explaining the relationship between a radiation monitor and an external circuit.

The total of gaseous molecules in an ionization space must not vary depending on an air pressure or temperature. Each of a high-voltage electrode 2 and a collecting electrode 3 is formed with a thin metallic or metal-deposited insulating sheet. Therefore, the radiation monitor shown in FIG. 1A can apply not only to X rays but also to electron beams and other corpuscular radiations. Furthermore, the problems of a radiation monitor shown in FIG. 8 can be solved.

An ionization space 1 is unaffected by the air, but the external surface is affected by the state of the air, in particular, by humidity. When humidity increases, the external surface of a frame 4 easily conducts current. This induces so-called creeping leakage current. When creeping leakage current flows between a high-voltage electrode 2 and a collecting electrode 3, a radiation is monitored incorrectly. To prevent this incorrect monitoring, a protective earth electrode 14 is interposed between the electrodes 2 and 3 in such a way that the protective earth electrode 14 will be in contact with the frame 4.

The incorporation of the protective earth electrode 14 allows leakage current, which is induced by a creeping electric field and originating from the high-voltage electrode 2, to flow into the earth and prevents the leakage current from reaching the collecting electrode 3. Furthermore, when a ditch 13 is dug on the frame 4, the creeping distance from the high-voltage electrode to earth electrode 14 is extended equivalently. This prevents leakage current from developing. The ditch 13 is not limited to one ditch but may include multiple ditches.

Figure 2:
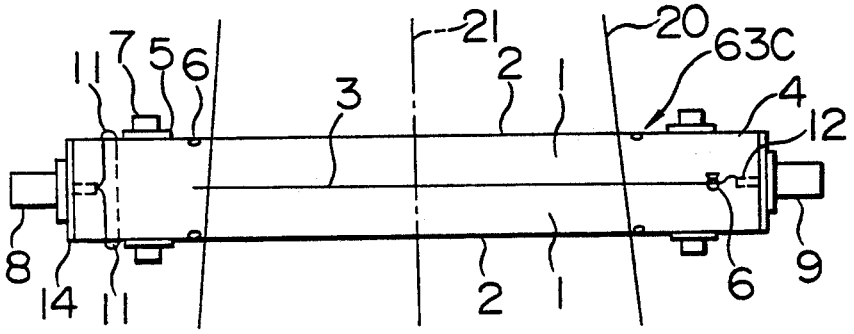
FIG. 2 is a schematic cross-sectional diagram showing a radiation monitor according to other embodiment of the invention.

Next, a radiation monitor of FIG. 2 will be described. FIG. 2 shows a radiation monitor 63C or an applied example of that of FIG. 1. Two plates of electrodes forming an ionization space 1 are high-voltage electrodes 2. A collecting electrode 3 is held in the airtight space. The collecting electrode 3 is connected to a collecting electrode connector 9 via a lead routed inside a frame 4 and a seal 6 for ensuring airtightness. High voltage is supplied to the two plates of high-voltage electrodes 2 over a lead via a high-voltage electrode connector 8.

Thus, an ionization space 1 is formed across the collecting electrode 3. This provides an about double ionization current of that in the radiation monitor of FIG. 1A. Therefore, the sensitivity of detecting a dose is nearly doubled to improve monitoring precision.

In FIG. 3, a metal-deposited insulating sheet is used as a collecting electrode. A plane deposited to have the pattern shown in FIG. 3 is used to form two electrodes 3*a* and 3*b*. Thereby, ionization currents can be extracted independently from different regions of a radiation distribution via connectors 9*a* and 9*b*.

When the independent ionization currents are monitored simultaneously, uniformity levels can be detected in the radiation distribution. A difference in uniformity level between the regions is fed back to produce a signal for stabilizing the state of a radiation generating apparatus. When the split-electrode gap is minimized, the states of individual ionization spaces are approximated to the expression (6). Consequently, the radiation monitor of FIG. 3 can be used as a dose distribution monitor hardly affected by an air pressure or temperature.

In FIG. 3, a collecting electrode is split to two portions 3*a* and 3*b*. The collecting electrode may be split into four portions symmetrically with respect to a beam center axis 2 (by 90° radially around the beam center axis). This permits more detail monitoring of a dose distribution.

FIG. 4 shows an example in which the pressure in an airtight space forming an ionization space 1 is held higher than the air pressure in an atmosphere of using an apparatus generally. In a radiation monitor 63D, two plates of electrodes 2 and 3 forming an ionization space are highly tensed. Even when an external air pressure or temperature changes, the internal pressure is held higher. Thereby, the electrodes warp slightly, thus stabilizing a potential distribution in the ionization space 1. As a result, monitored values of a dose become constant.

If the internal and external air pressures of an airtight space are substantially equal to that for general use, the air pressure of the airtight space becomes higher or lower than the external air pressure depending on an air pressure or temperature. This causes the electrodes 2 and 3 to warp and wane. However, the electrodes do not become perfectly flat on the boundary state of the warp and wane. Therefore, a potential distribution in the ionization space deforms and becomes unstable. This results in an unstable ionization current. For this reason, the air pressure of the ionization space 1 is held higher than an external air pressure as shown in FIG. 4.

In FIG. 4, the air pressure in an ionization space is held higher than an external air pressure. For the same purpose, the air pressure in the ionization space may be held lower. However, since an ionization current is proportional to the number of gaseous molecules existent in an ionization space 1, if an ionization current value should be increased even slightly, it will be more advantageous that the air pressure in the ionization space is held higher.

FIG. 5 shows an actual example of a radiation monitor. Two of radiation monitors 63A to 63D are lined side by side along a radiation 20, and locked in a fixing frame 29. Then, a metallic cover 28 is used to prevent the external surfaces of the two of the radiation monitors 63A to 63D from being damaged externally. The metallic cover 28 also protects a human being from a high-voltage electrode or other structure.

In FIG. 5, two of radiation monitors 63A to 63D are employed. Any combination of the radiation monitors 63A to 63D shown in FIGS. 1A and 1B to 4 is conceivable. The number of radiation monitors is not restricted to two but may be three or more. Then, the radiation monitor or monitors are implemented as a radiation monitor 63 in a medical linac.

The aforesaid embodiments are based on X rays or electron beams. The application to other radiations; such as, gamma rays, alpha rays, and transmission corpuscular radiations will also be advantageous. A medical linac has been introduced as a radiation generating apparatus. Alternatively, the present invention may apply to a non-destructive inspection linac, a microtron, betatron, or $^{60}Co$ irradiation apparatus, a non-electron particle accelerator, or other radiation generating apparatus, offering the same advantages. Furthermore, the invention can also apply to a radiation irradiation apparatus yielding a low radiation energy of less than 1 MeV, and have the same advantages.

A seal 6 is usually made of organic material, which may deteriorate with the influence of a radiation. Alternatively, a bracket 5 may be flanged to retain airtightness.

The present invention have the aforesaid configuration, offering the advantages described below.

An ionization space formed with a frame made of insulating material, a high-voltage electrode, and a collecting electrode opposing the high-voltage electrode has an equal dimension throughout the passage of a radiation. Thereby, the Boyle-Charles' law applies substantially perfectly to the ionization space. An ionization current unaffected by an ambient pressure or temperature can be extracted, obviating a compensation circuit for compensating for the influence of an air pressure or temperature. This results in low manufacturing cost.

Moreover, an ionization space, which is formed across a collecting electrode, provides a double ionization current. This nearly doubles the sensitivity of detecting a dose and eventually improves monitoring precision.

Furthermore, a collecting electrode, which is split into multiple portions, provides the ionization currents of different fields in a radiation distribution. This permits detailed monitoring of a dose distribution.

Moreover, the pressure in an ionization space is held higher or lower than an air pressure. Therefore, despite a variation in ambient temperature or air pressure, the internal potential distribution of the ionization space is stable. Consequently, monitored values of a dose are constant.

What is claimed is:

1. A radiation monitor for a radiation generating apparatus which generates a radiation beam having a conical shape along a longitudinal axis thereof, comprising:

a frame made of an insulating material;

a high-voltage electrode;

a collecting electrode opposing said high-voltage electrode; and a ditch circumferentially located on an end of said radiation monitor;

wherein said ditch prevents leakage current from flowing along said frame between said high-voltage electrode and said collecting electrode, wherein an ionization space for developing ionization current from passage of said radiation beam therethrough being formed by said frame, said high-voltage electrode and said collecting electrode.

2. A radiation monitor according to claim 1 wherein said ionization space is formed with a frame made of insulating material, two opposing high-voltage electrodes, and a collecting electrode interposing between the high-voltage electrodes.

3. A radiation monitor according to claim 1 wherein a collecting electrode forming said ionization space includes a plurality of electrodes.

4. A radiation monitor for a radiation generating apparatus which generates a radiation beam having a conical shape along a longitudinal axis thereof, comprising:

a frame made of an insulating material;

a high-voltage electrode; and a collecting electrode opposing said high-voltage electrode;

a ditch circumferentially located on an end of said radiation monitor;

wherein said ditch prevents leakage current from flowing along said frame from said high-voltage electrode and said collecting electrodes, and wherein an airtight closed space is defined by said frame, said high-voltage electrode, and said collecting electrode, and an ionization space for developing ionization current from passage of said radiation beam therethrough being formed to be coextensive with said airtight closed space and also coextensive with a conic section of said radiation beam passing therethrough.

5. A radiation monitor according to claim 4, wherein the pressure in said ionization space is higher or lower than ambient air pressure.

* * * * *